US010992113B2

(12) United States Patent
Muramoto et al.

(10) Patent No.: US 10,992,113 B2
(45) Date of Patent: Apr. 27, 2021

(54) IGNITION APPARATUS

(71) Applicant: Mitsubishi Electric Corporation, Tokyo (JP)

(72) Inventors: Yuichi Muramoto, Tokyo (JP); Yusuke Naruse, Tokyo (JP); Naoki Kataoka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/802,776

(22) Filed: Feb. 27, 2020

(65) Prior Publication Data

US 2020/0358263 A1 Nov. 12, 2020

(30) Foreign Application Priority Data

May 9, 2019 (JP) ..... JP2019-088805

(51) Int. Cl.
*H01T 15/00* (2006.01)
*H01F 27/28* (2006.01)
(Continued)

(52) U.S. Cl.
CPC ..... *H01T 15/00* (2013.01); *F02P 3/02* (2013.01); *F02P 3/045* (2013.01); *F02P 3/08* (2013.01);
(Continued)

(58) Field of Classification Search
CPC ..... H01T 15/00; H01F 27/28; H01F 38/12; F02P 3/02; F02P 3/045; F02P 15/10; F02P 23/00; F02P 3/08
See application file for complete search history.

(56) References Cited

U.S. PATENT DOCUMENTS 8,096,276 B2 * 1/2012 Aida ..... F02P 3/0876 123/143 B
9,399,979 B2 * 7/2016 Heise ..... F02P 3/0407
(Continued)

FOREIGN PATENT DOCUMENTS

JP 2016-217189 A 12/2016
JP 2019031911 A 2/2019
WO 2016157541 A1 10/2016

OTHER PUBLICATIONS

Communication dated Mar. 17, 2020, from the Japanese Patent Office in application No. 2019-088805.

*Primary Examiner* — Syed O Hasan
(74) *Attorney, Agent, or Firm* — Sughrue Mion, PLLC; Richard C. Turner

(57) ABSTRACT

To provide an ignition apparatus which can turn on and off the sub primary coil according to extension degree of the discharge path of the spark discharge. An ignition apparatus is provided with an ignition coil that is provided with a main primary coil, a sub primary coil which generates energization magnetic flux of a direction opposite to the energization magnetic flux of the main primary coil, and a secondary coil which is magnetically coupled with the main primary coil and the sub primary coil and supplies spark discharge energy to a spark plug; and after turning off energization to the main primary coil, based on a detection value of terminal voltage of the main primary coil, turns on and off the sub switch circuit to turn on and off energization to the sub primary coil and additionally supply spark discharge energy to the secondary coil.

9 Claims, 8 Drawing Sheets

(51) Int. Cl.

| | |
|---|---|
| ***H01F 38/12*** | (2006.01) |
| ***F02P 3/08*** | (2006.01) |
| ***F02P 23/00*** | (2006.01) |
| ***F02P 3/02*** | (2006.01) |
| ***F02P 3/045*** | (2006.01) |

(52) U.S. Cl.
CPC ..... *F02P 23/00* (2013.01); *H01F 27/28* (2013.01); *H01F 38/12* (2013.01)

(56) References Cited

U.S. PATENT DOCUMENTS

| | | | | |
|---|---|---|---|---|
| 2005/0000502 | A1* | 1/2005 | Waters | F02P 3/051 123/620 |
| 2012/0293088 | A1* | 11/2012 | Tanaya | F02P 3/0892 315/224 |
| 2017/0284358 | A1* | 10/2017 | Skowronek | F02P 9/002 |
| 2018/0266381 | A1 | 9/2018 | Kosuge et al. | |
| 2019/0040834 | A1 | 2/2019 | Nishio et al. | |
| 2019/0311849 | A1* | 10/2019 | Idogawa | H01F 38/12 |

* cited by examiner

IGNITION APPARATUS

INCORPORATION BY REFERENCE

The disclosure of Japanese Patent Application No. 2019-88805 filed on May 9, 2019 including its specification, claims and drawings, is incorporated herein by reference in its entirety.

BACKGROUND

The present disclosure relates to an ignition apparatus.

Leaning and EGR increase are studied for fuel economy improvement of the internal combustion engine. However, since ignitability of fuel air mixture is not good, energy increase of the ignition apparatus, especially current increase are required. Then, there has been proposed an ignition apparatus that additionally superimposes a current by energization of another primary coil (sub primary coil) on a secondary current, which is generated in the secondary coil by shutting energization of the conventional primary coil (main primary coil) (see, for example, U.S. Pat. No. 9,399,979 B and JP 2016-217189 A).

In the technology of U.S. Pat. No. 9,399,979 B and JP 2016-217189 A, in order to optimize the added secondary current amount in such ignition apparatus, the secondary current is detected and energization timing of the sub primary coil is controlled.

SUMMARY

By the way, according to an extension degree of a discharge path of spark discharge, necessity for increase in the secondary current by energization of the sub primary coil changes.

However, in the technology of U.S. Pat. No. 9,399,979 B and JP 2016-217189 A, since on/off control of the sub primary coil is only started when a detection value of the secondary current is less than a threshold value after discharge starting, the on/off control of the sub primary coil cannot be carried out finely according to discharge state. Especially, during ON period of the sub primary coil, since the secondary current increases by additional energy of the sub primary coil, information on length of the discharge path cannot be detected according to the secondary current.

Thus, it is desirable to provide an ignition apparatus which can turn on and off the sub primary coil according to extension degree of the discharge ah of the spark discharge.

An ignition apparatus according to the present disclosure including:

an ignition coil that is provided with a main primary coil which generates energization magnetic flux by energization, a sub primary coil which generates energization magnetic flux of a direction opposite to the energization magnetic flux of the main primary coil by energization, and a secondary coil which is magnetically coupled with the main primary coil and the sub primary coil and supplies spark discharge energy to a spark plug;

a main switch circuit that turns on and off energization to the main primary coil from a DC power source;

a sub switch circuit that turns on and off energization to the sub primary coil from the DC power source;

a main voltage detection circuit that detects a terminal voltage of the main primary coil;

a main coil control unit that turns on the main switch circuit to turn on energization to the main primary coil, and then turns off the main switch circuit to turn off energization to the main primary coil and makes the ignition plug generate spark discharge; and a sub coil control unit that, after turning off energization to the main primary coil, based on a detection value of the terminal voltage of the main primary coil, turns on and off the sub switch circuit to turn on and off energization to the sub primary coil and additionally supply spark discharge energy to the secondary coil.

According to the ignition apparatus of the present disclosure, based on the detection value of the primary voltage which is proportional to length of the discharge path of the spark discharge, the sub primary coil can be energized appropriately according to necessity for strengthening of the spark discharge which changes according to extension degree of the discharge path.

DETAILED DESCRIPTION OF THE EMBODIMENTS

Hereinafter, embodiment of an ignition apparatus 1 according to present disclosure will be explained in detail with reference to drawings.

1. Embodiment 1

Figure 1:
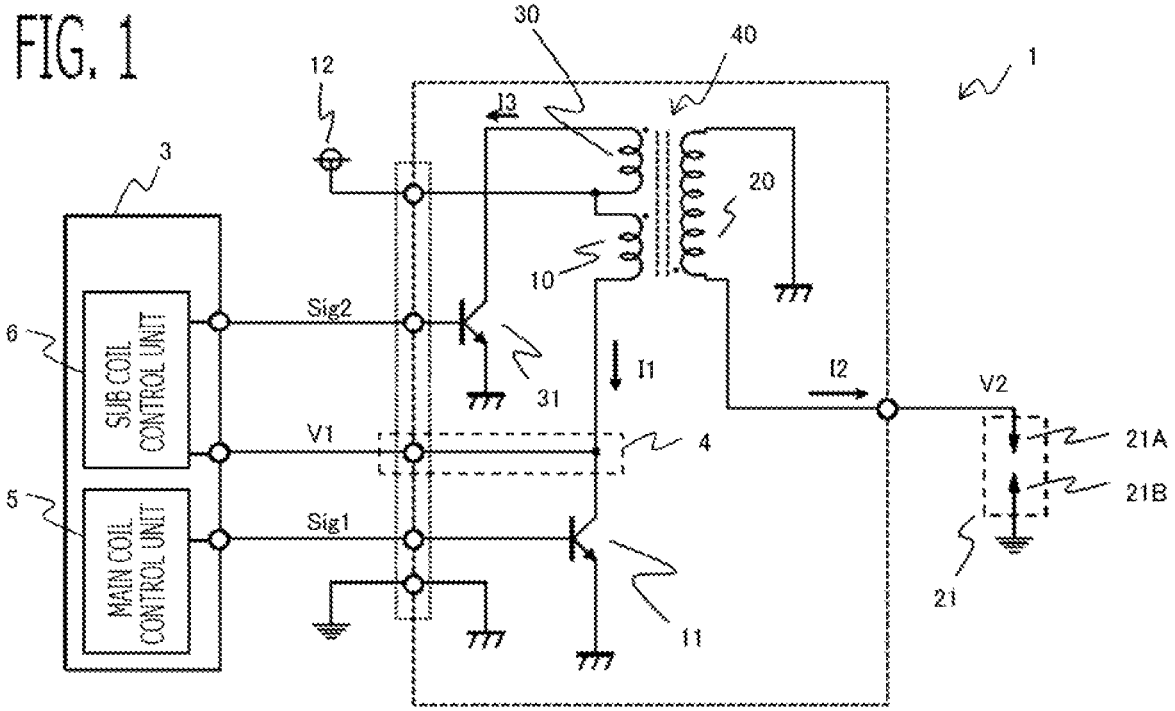
FIG. 1 is a schematic circuit diagram of the ignition apparatus according to Embodiment 1.

FIG. 1 is an electric diagram showing the basic configuration of the ignition apparatus 1 according to Embodiment 1. As shown in FIG. 1, the ignition apparatus 1 is provided with an ignition plug 21, an ignition coil 40, a main switch circuit 11, a sub switch circuit 31, a main voltage detection circuit 4, a main coil control unit 5, a sub coil control unit 6, and the like.

1-1. Basic Configuration of Ignition Apparatus

The ignition plug 21 is provided with a first electrode 21A and a second electrode 21B which oppose via a gap, and ignites a combustible gas mixture in a combustion chamber. The first electrode 21A and the second electrode 21B of the ignition plug 21 are arranged in the combustion chamber (inside the cylinder). The first electrode 21A is connected to a secondary coil 20, and the second electrode 21B is connected to a ground.

The ignition coil 40 is provided with a main primary coil 10 which generates energization magnetic flux by energization, a sub primary coil 30 which generates energization magnetic flux of a direction opposite to the energization magnetic flux of the main primary coil 10 by energization, and a secondary coil 20 which is magnetically coupled with the main primary coil 10 and the sub primary coil 30 and supplies spark discharge energy to a spark plug 21. The main primary coil 10, the sub primary coil 30, and the secondary coil 20 are wound around a common iron core. A winding number of the secondary coil 20 is more than a winding number of the main primary coil 10.

One end of the main primary coil 10 and the other end of the sub primary coil 30 are connected to the same DC power source 12. The other end of the main primary coil 10 is connected to the ground via the main switch circuit 11. One end of the sub primary coil 30 is connected to the ground via the sub switch circuit 31.

Each coil is wound and connected to the DC power source 12, so that the direction of the magnetic flux generated when the main switch circuit 11 is turned on and the main primary coil 10 is energized, and the direction of the magnetic flux generated when the sub switch circuit 31 is turned on and the sub primary coil 30 is energized become opposite directions to each other.

The main switch circuit 11 is a switching circuit which turns on and off the energization to the main primary coil 10 from the DC power source 12. A command signal Sig1 outputted from the main coil control unit 5 (the controller 3) is inputted into the main switch circuit 11, and the main switch circuit 11 is turned on and off by the command signal Sig1.

The sub switch circuit 31 is a switching circuit which turns on and off the energization to the sub primary coil 30 from the DC power source 12. A command signal Sig2 outputted from the sub coil control unit 6 (the controller 3) is inputted into the sub switch circuit 31, and the sub switch circuit 31 is turned on and off by the command signal Sig2.

For example, IGBT (Insulated Gate Bipolar Transistor), MOSFET (Metal Oxide Semiconductor Field Effect Transistor), or transistor is used for the main switch circuit 11 and the sub switch circuit 31.

One end of the secondary coil 20 is connected to the first electrode 21A of the ignition plug 21, and the other end of the secondary coil 20 is connected to the ground.

The main voltage detection circuit 4 is a circuit for detecting a terminal voltage V1 (hereinafter, referred to also as a primary voltage V1) of the main primary coil 10. The main voltage detection circuit 4 detects a terminal voltage on the main switch circuit 11 side of the main primary coil 10. The main voltage detection circuit 4 is a wire connected to a connection line which connects between the main primary coil 10 and the main switch circuits 11, and the other end of the wire is connected to the controller 3. That is to say, the main voltage detection circuit 4 is a wire which inputs the terminal voltage of the main primary coil 10 into the controller 3. The main voltage detection circuit 4 may be provided with a resistive potential divider, and a divided voltage of the terminal voltage V1 of the main primary coil 10 may be inputted into the controller 3.

1-2. Controller

Figure 2:
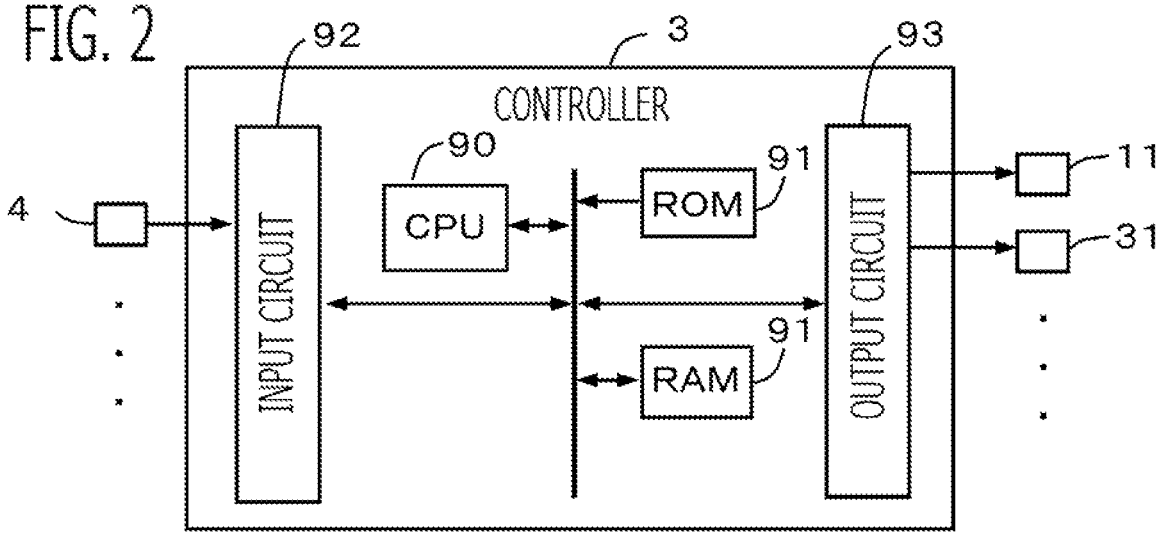
FIG. 2 is a hardware configuration diagram of the controller according to Embodiment 1.

In the present embodiment, the main coil control unit 5 and the sub coil control unit 6 are provided in the controller 3. The controller 3 is a controller for an internal combustion engine which controls an internal combustion engine. Each function of the controller 3 is realized by processing circuits provided in the controller 3. Specifically, as shown in FIG. 2, the controller 3 is provided, as processing circuits, with an arithmetic processor (computer) 90 such as a CPU (Central Processing Unit), storage apparatuses 91 which exchange data with the arithmetic processor 90, an input circuit 92 which inputs external signals to the arithmetic processor 90, an output circuit 93 which outputs signals from the arithmetic processor 90 to the outside, and the like.

As the arithmetic processor 90, ASIC (Application Specific Integrated Circuit), IC (integrated Circuit), DSP (Digital Signal Processor), FPGA (Field Programmable Gate Array), various kinds of logical circuits, various kinds of signal processing circuits, and the like may be provided. As the arithmetic processor 90, a plurality of the same type ones or the different type ones may be provided, and each processing may be shared and executed. As the storage apparatuses 91, there are provided a RAM (Random Access Memory) which can read data and write data from the arithmetic processor 90, a ROM (Read Only Memory) which can read data from the arithmetic processor 90, and the like. The input circuit 92 is connected with various kinds of sensors and switches such as the main voltage detection circuit 4, a crank angle sensor, a cam angle sensor, an intake air amount detection sensor, a water temperature sensor, and a power source voltage sensor, and is provided with an A/D converter and the like for inputting output signals from the sensors and the switches to the arithmetic processor 90. The output circuit 93 is connected with electric loads such as the main switch circuit 11, the sub switch circuit 31, and an injector, and is provided with a driving circuit and the like for outputting a control signal from the arithmetic processor 90.

Then, the arithmetic processor 90 runs software items (programs) stored in the storage apparatus 91 such as a ROM and collaborates with other hardware devices in the controller 3, such as the storage apparatus 91, the input circuit 92, and the output circuit 93, so that the respective functions of the control units 5, 6 provided in the controller 3 are realized. Setting data items such as a threshold and a determination value be utilized in the controller 3 are stored, as part of software items (programs) in the storage apparatus 91 such as a ROM.

As basic control, the controller 3 calculates a rotational speed of the internal combustion engine, charging efficiency, fuel injection amount, ignition timing, and the like, based on inputted output signals and the like from the various kinds of sensors, and performs driving control of the injector, the main switch circuit 11, and the like.

<Main Ignition Control>

The main coil control unit 5 turns on the main switch circuit 11 to turn on energization to the main primary coil 10, and then turns off the main switch circuit 11 to turn off energization to the main primary coil 10 and makes the ignition plug 21 generate spark discharge.

The main coil control unit 5 calculates an energizing period to the main primary coil 10, and an ignition timing (ignition crank angle). The main coil control unit 5 turns on the main switch circuit 11 during the energizing period and energizes the main primary coil 10. After that, the main coil control unit 5 turns off the main switch circuit 11 at the ignition timing, shuts off the energization to the main primary coil 10, makes the secondary coil 20 generate the high voltage, and makes the ignition plug 21 generate spark discharge. The spark discharge continues until the magnetic energy accumulated in the iron core of the spark plug 21 decreases.

<Sub Primary Coil Control>

When the sub primary coil 30 is energized during the spark discharge, additional magnetic energy is supplied to the secondary coil 20, and a magnitude (absolute value) of the secondary current I2 which flows through the discharge path increases. Accordingly, the spark discharge is strengthened, and ignitability of fuel-air mixture and extensibility of the spark discharge are strengthened. On the other hand, by strengthening of the spark discharge by energization of the sub primary coil 30, power consumption increases and abrasion of the spark plug 21 increases. Therefore, according to necessity, it is desired to energize the sub primary coil 30.

Figure 3:
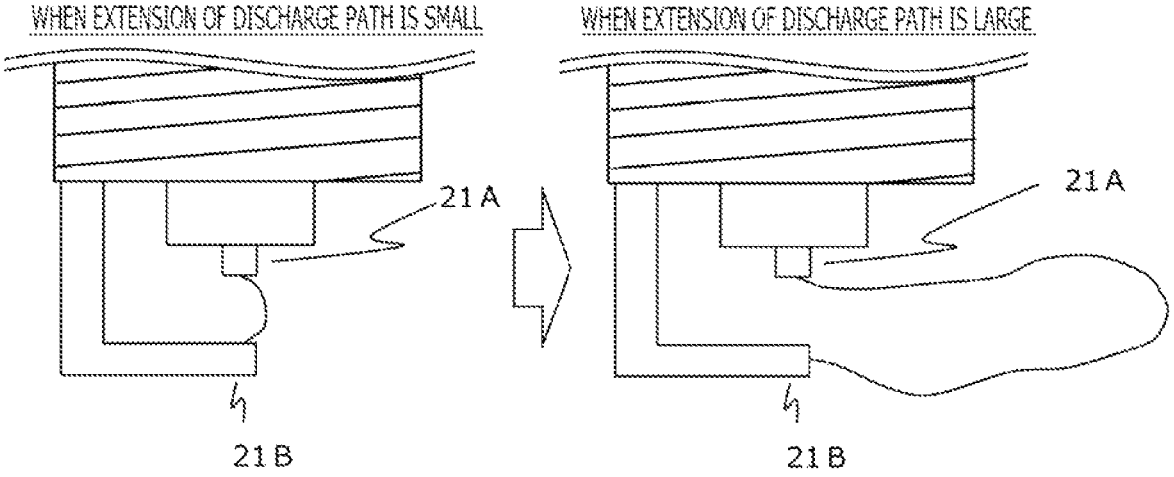
FIG. 3 is a figure explaining the in-cylinder flow and the extension of the discharge path according to Embodiment 1.

A voltage between gaps of the ignition plug 21 (secondary voltage V2) changes according to air flow, temperature, and pressure in the cylinder. And, when a magnitude (absolute value) of the secondary voltage V2 becomes large, a magnitude of the primary voltage V1 generated in the main primary coil 10 also becomes large proportionally by the transformer structure of the ignition coil 40. Especially, as shown in the right side of FIG. 3, when the air flow in the cylinder is strong, the discharge path of the spark discharge between gaps of the ignition plug 21 extends. And, as the discharge path becomes long, the magnitude of the secondary voltage V2 increases and the magnitude of the primary voltage V1 increases. According to extension degree of the discharge path of this spark discharge, necessity for strengthening of the spark discharge by energization of the sub primary coil 30 changes. Therefore, according to extension degree of the discharge path of this spark discharge, it is desired to energize the sub primary coil 30.

Then, the sub coil control unit 6 detects a terminal voltage V1 (hereinafter, referred to as a primary voltage V1) of the main primary coil 10, based on the output signal of the main voltage detection circuit 4. After turning off energization to the main primary coil 10, based on a detection value of the primary voltage V1, the sub coil control unit 6 turns on and off the sub switch circuit 31 to turn on and off energization to the sub primary coil 30 and additionally supply spark discharge energy to the secondary coil 20.

According to this configuration, based on the detection value of the primary voltage V1 proportional to length of the discharge path of spark discharge, according to the necessity for strengthening of the spark discharge which changes according to the extension degree of the discharge path, the sub primary coil 30 can be energized appropriately.

<Low Primary Voltage on Control>

In the case of an operating condition where ignitability can be secured by extending the discharge path, even if the sub primary coil 30 is energized when the discharge path becomes long, ignitability is not improved, power consumption increases, and abrasion of the spark plug 21 increases. As such an operating condition, for example, there are the case of high load where charging efficiency of the fuel-air mixture charged in the cylinder is high, and the case where the fuel-air mixture in the cylinder is rich.

Then, the sub coil control unit 6 performs a low primary voltage on control that turns on the sub switch circuit 31 to turn on energization to the sub primary coil 30 when the detection value of the terminal voltage V1 of the main primary coil is less than a threshold value V1th, and turns off the sub switch circuit 31 to turn off energization to the sub primary coil 30 when the detection value of the terminal voltage V1 of the main primary coil exceeds the threshold value V1th. The threshold value V1th may be changed according to the driving condition of the internal combustion engine, such as charging efficiency, air-fuel ratio, and rotational speed.

According to this configuration, when the detection value of primary voltage V1 exceeds the threshold value V1th and it can be determined that the discharge path becomes long, the energization to the sub primary coil 30 can be stopped, and the increase in unnecessary power consumption and the increase in abrasion of the ignition plug 21 can be suppressed.

A behavior of the low primary voltage on control will be explained using the time chart shown in FIG. 4. At the time t11 of FIG. 4, the main coil control unit 5 switches the command signal Sig1 to the main switch circuit 11 from OFF to ON, the main primary coil 10 is energized, and the primary current I1 flows. After that, at the time t12 when the energizing period elapsed, when the main coil control unit 5 switches the command signal Sig1 from ON to OFF and shuts down the energization of the main primary coil 10, a negative high voltage of the secondary voltage V2 is generated in the secondary coil 20 and applied to the first electrode 21A of the ignition plug 21, its potential drops steeply and reaches a breakdown voltage. Then, the spark discharge is generated between the gaps of the first electrode 21A and the second electrode 21B of the ignition plug 21. When the spark discharge starts, the secondary voltage V2 increase from the breakdown voltage, and becomes a discharge maintaining voltage.

When the spark discharge starts at the time t12, the secondary current I2 decreases stepwise from zero. After that, the secondary current I2 decreases gradually as the magnetic energy accumulated in the iron core decreases. Then, at the time t16, the secondary current I2 becomes zero and the spark discharge is finished.

Figure 4:
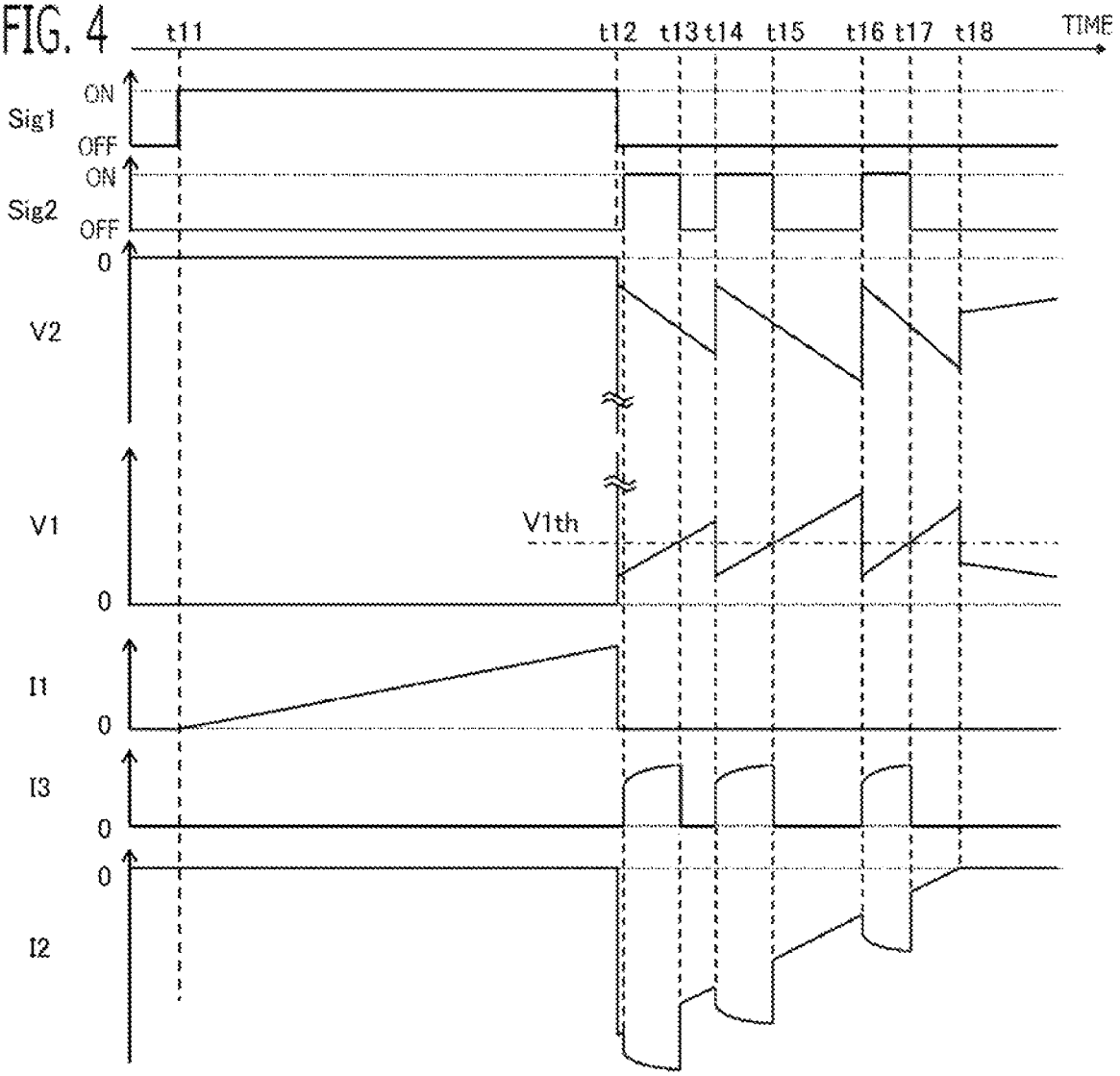
FIG. 4 is a time chart for explaining a control behavior of the low primary voltage on control according to Embodiment 1.

In the example shown in FIG. 4, a flow in the cylinder is large, the discharge path is extending gradually after start of the spark discharge, and the secondary voltage V2 drops gradually according to extension of the discharge path. By the transformer structure of the ignition coil 40, the primary voltage V1 also changes in proportion to the positive/negative reversing value of the secondary voltage V2, and the primary voltage V1 increases gradually according to extension of the discharge path.

In the example of FIG. 4, the spark discharge is blown off at the time t14 and the time t16. At every time, the length of the discharge path becomes short and extends gradually after that. According to it, at the time t14 and the time t16, the magnitudes of the secondary voltage V2 and the primary voltage V1 also once become small, and increase gradually after that.

Since the primary voltage V1 is less than the threshold value V1th from just after the time t12 to the time t13 after discharge starting, the sub coil control unit 6 switches the command signal Sig2 to the sub switch circuit 31 from OFF to ON, energizes the sub primary coil 30, and makes a current I3 (hereinafter, referred to as a sub primary current I3) flow through the sub primary coil 30. Accordingly, spark discharge energy is additionally supplied to the secondary coil 20, and the magnitude of the secondary current I2 which flows through the discharge path increases by the additional energy.

On the other hand, since the primary voltage V1 exceeds the threshold value V1th from the time t13 to the time t14 by extension of the discharge path, the sub coil control unit 6 switches the command signal Sig2 to the sub switch circuit 31 from ON to OFF, energization to the sub primary coil 30 is turned off, and the sub primary current I3 becomes zero. Accordingly, the additional supply of the spark discharge energy to the secondary coil 20 stops, and the magnitude of the secondary current I2 drops to a usual value. Therefore, in the case where the discharge path becomes long and ignitability can be secured, the energization to the sub primary coil 30 can be stopped, and the increase in unnecessary power consumption and the increase in abrasion of the ignition plug 21 can be suppressed.

At the time t14, when the primary voltage V1 drops and is less than the threshold V1th by blow off of the spark discharge, the command signal Sig2 to the sub switch circuit 31 is again switched from OFF to ON, and the sub primary coil 30 is energized. Then, when the primary voltage V1 exceeds the threshold value V1th at the time t15 by extension of the discharge path, the command signal Sig2 to the sub switch circuit 31 is switched from ON to OFF, and the energization to the sub primary coil 30 is stopped. Since the spark discharge was again blown off at the time t16, similarly, the energization to the sub primary coil 30 is started, and the energization to the sub primary coil 30 is stopped at the time t17 by extension of the discharge path. In this way, even if the blow off of the spark discharge occurs, the energization to the sub primary coil 30 can be appropriately turned on and off according to extension of the discharge path, based on the primary voltage V1

<High Primary Voltage on Control>

On the other hand, in the case of an operating condition where the spark discharge is easily blown off when the discharge path becomes long, by energizing the sub primary coil 30 and strengthening the spark discharge when the discharge path becomes long, the spark discharge can be hardly blown off, and ignitability can be improved. As such an operating condition, for example, there is the case of high speed region where the rotational speed of the internal combustion engine is high. In the high speed region, the in-cylinder flow becomes strong too much, and the spark discharge is easily blown off.

Then, the sub coil control unit 6 performs a high primary voltage on control that turns on the sub switch circuit 31 to turn on energization to the sub primary coil 30 when the detection value of the terminal voltage V1 of the main primary coil exceeds the threshold value V1th, and turns off the sub switch circuit 31 to turn off energization to the sub primary coil 30 when the detection value of the terminal voltage V1 of the main primary coil is less than the threshold value V1th. The threshold value V1th may be changed according to the driving condition of the internal combustion engines, such as charging efficiency, air-fuel ratio, and rotational speed. The threshold value V1th of the high primary voltage on control may be set to a different value from the threshold value V1th of the low primary voltage on control.

According to this configuration, when the detection value of primary voltage V1 exceeds the threshold value V1th and it can be determined that the discharge path becomes long, by energizing the sub primary coil 30 and strengthening the spark discharge, the spark discharge can be hardly blown off, and ignitability can be improved.

Figure 5:
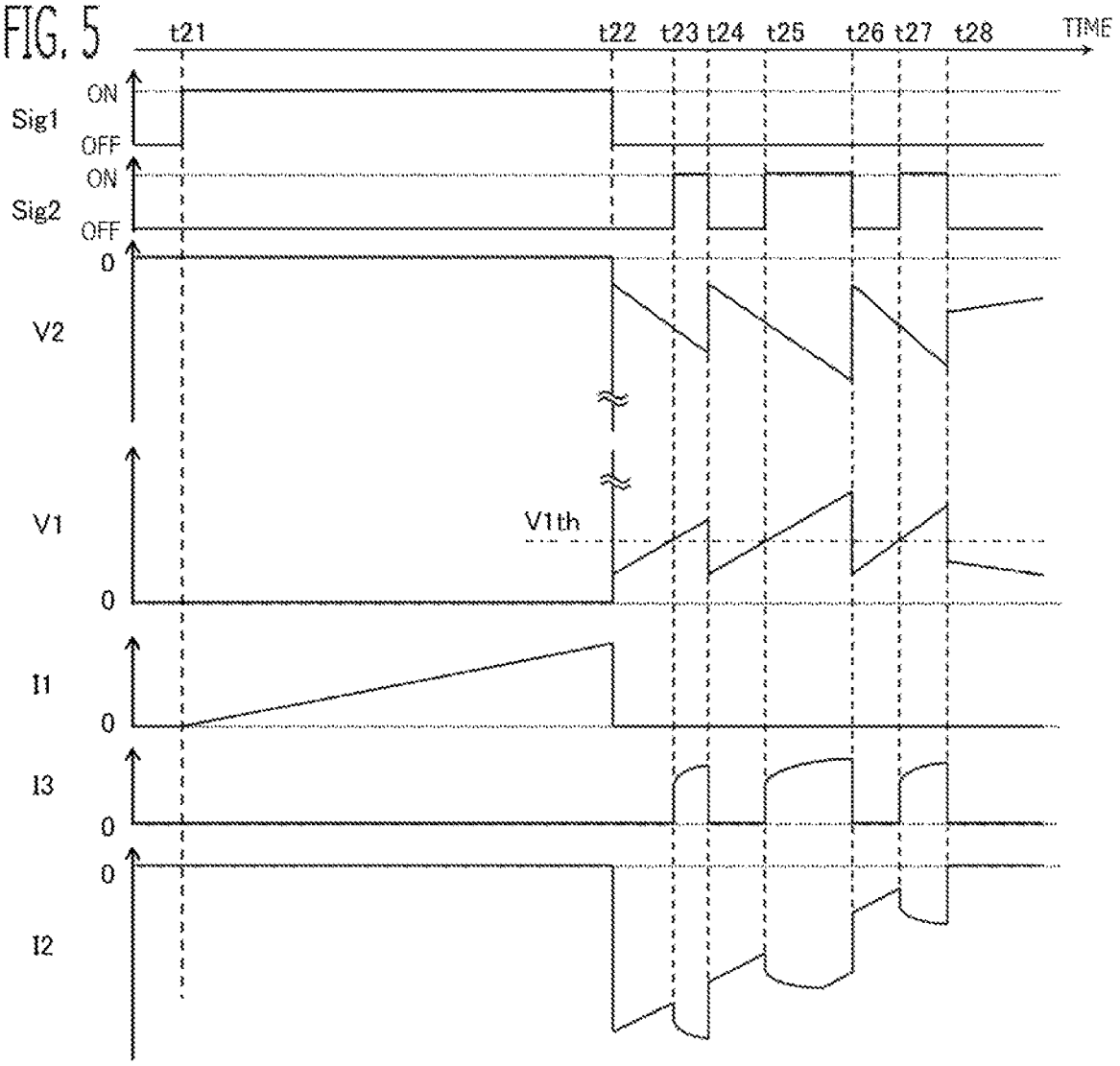
FIG. 5 is a time chart for explaining a control behavior of the high primary voltage on control according to Embodiment 1.

A behavior of the high primary voltage on control will be explained using the time chart shown in FIG. 5. Since the time t21 to the time t22 of FIG. 5 is the same as the time t11 to the time t12 of FIG. 4, explanation is omitted. At the time t22, when the spark discharge starts, after the secondary current I2 increases stepwise from zero, the secondary current I2 decreases gradually as the magnetic energy accumulated in the iron core decreases. Then, at the time t28, the secondary current I2 becomes zero and the spark discharge is finished.

In the example shown in FIG. 5, the flow in the cylinder is large, the discharge path is extending gradually after start of the spark discharge, and the secondary voltage V2 drops gradually according to extension of the discharge path. By the transformer structure of the ignition coil 40, the primary voltage V1 also changes in proportion to the positive/negative reversing value of the secondary voltage V2, and the primary voltage V1 increases gradually according to extension of the discharge path.

In the example of FIG. 5, the spark discharge is blown off at the time t24 and the time t26. At every time, the length of the discharge path becomes short and extends gradually after that. According to it, at the time t24 and the time t26, the magnitudes of the secondary voltage V2 and the primary voltage V1 also once become small, and increase gradually after that.

Since the primary voltage V1 is less than the threshold value V1th from the time t22 to the time t23 after discharge starting, the sub coil control unit 6 keeps the command signal Sig2 to the sub switch circuit 31 turned off. In the case where the discharge path does not become long and the spark discharge is not easily blown off, energization to the sub primary coil 30 is not performed, and the increase in unnecessary power consumption and the increase in abrasion of the ignition plug 21 can be suppressed.

On the other hand, since the primary voltage V1 exceeds the threshold value V1th from the time t23 to the time t24 by extension of the discharge path, the sub coil control unit 6 switches the command signal Sig2 to the sub switch circuit 31 from OFF to ON, the sub primary coil 30 is energized, and the sub primary current I3 flows into the sub primary coil 30. Accordingly, spark discharge energy is additionally supplied to the secondary coil 20, and the magnitude of the secondary current I2 which flows through the discharge path increases by the additional energy. As a result, even in the case where the discharge path became long and the spark discharge is easily blown off, by energizing to the sub primary coil 30 and strengthening the spark discharge, the spark discharge can be hardly blown off, and ignitability can be improved.

At the time t24, when the primary voltage V1 drops and is less than the threshold V1th by blow off of the spark discharge, the command signal Sig2 to the sub switch circuit 31 is again switched from ON to OFF, and the energization to the sub primary coil 30 is stopped. Then, when the primary voltage V1 exceeds the threshold value V1th at the time t25 by extension of the discharge path, the command signal Sig2 to the sub switch circuit 31 is switched from OFF to ON, and the sub primary coil 30 is energized. Since the spark discharge was again blown off at the time t26, similarly, the energization to the sub primary coil 30 is stopped, and the energization to the sub primary coil 30 is started at the time t27 by extension of the discharge path. In this way, even if the blow off of the spark discharge occurs, the energization to the sub primary coil 30 can be appropriately turned on and off according to extension of the discharge path, based on the primary voltage V1.

<Switching Between the Low Primary Voltage on Control and the High Primary Voltage on Control According to an Operating Condition>

In the present embodiment, the sub coil control unit 6 switches and performs the low primary voltage on control and the high primary voltage on control according to an operating condition of the internal combustion engine.

According to this configuration, the energization control of the sub primary coil 30 is switched according to necessity which is changed by operating condition. And, improvement in ignitability, suppression of increase in power consumption, and increase in abrasion of the ignition plug can be balanced.

The sub coil control unit 6 performs the low primary voltage on control when a preliminarily set execution condition of the low primary voltage on control is established, and performs the high primary voltage on control when a preliminarily set execution condition of the high primary voltage on control is established. For example, the execution condition of the low primary voltage on control consists of condition that is established when the charging efficiency of the internal combustion engine is within a preliminarily set high load execution region, a condition that is established when the air-fuel ratio of the internal combustion engine is within a preliminarily set air-fuel ratio execution region, and the like. For example, the execution condition of the high primary voltage on control consists of a condition that is established when the rotational speed of the internal combustion engine is within a preliminarily set high speed region, and the like.

2. Embodiment 2

Next, the ignition apparatus 1 according to Embodiment 2 will be explained. The explanation for constituent parts the same as those in Embodiment 1 will be omitted. The basic configuration and processing of the ignition apparatus 1 according to the present embodiment are the same as those of Embodiment 1. However, in the present embodiment, the configuration of the sub coil control unit 6 is different from Embodiment 1.

When the charging efficiency is low and the pressure in cylinder is low (low load), or when the gap of the ignition plug 21 is narrow, the magnitude (absolute value) of the breakdown voltage becomes small, but since the resistance component of the discharge path also becomes small, the magnitude of the discharge maintaining voltage after dielectric breakdown also becomes small. In this case, since ignitability is low, it is better to perform positively the additional supply of the spark discharge energy by energization of the sub primary coil 30, in order to secure ignitability.

On the other hand, when the charging efficiency is high and the pressure in cylinder is high (high load), or when the gap of the ignition plug 21 is wide, the magnitude of the breakdown voltage becomes large, but since the resistance component of the discharge path also becomes large, the magnitude of the discharge maintaining voltage after dielectric breakdown also becomes large. In this case, since ignitability is high, it is not necessary to perform positively the additional supply of the spark discharge energy by energization of the sub primary coil 30.

Then, the sub coil control unit 6 changes the threshold value V1th in one or both of the high primary voltage on control and the low primary voltage on control according to a peak value of the detection value of the terminal voltage of the main primary coil (the primary voltage V1). Since the primary voltage V1 changes in proportion to the positive/negative reversing value of the secondary voltage V2, the peak value of the primary voltage V1 corresponds to the positive/negative reversing value of the breakdown voltage of the secondary voltage V2.

According to this configuration, the threshold value V1th is changed according to the peak value of the primary voltage V1, which is correlated with the charging efficiency of the internal combustion engine and the width of the gap of the ignition plug 21. And, the energizing period of the sub primary coil 30 can be increased or decreased appropriately.

In the present embodiment, when performing the low primary voltage on control, the sub coil control unit 6 decreases the threshold value V1th, as the peak value of the detection value of the primary voltage V1 just after turning off the energization to the main primary coil 10 is larger.

According to this configuration, it can be determined that as the peak value of the detection value of the primary voltage V1 becomes larger, the magnitude of the breakdown voltage of the secondary voltage V2 is large, and ignitability is high. Accordingly, the threshold value V1th can be decreased, the energizing period of the sub primary coil 30 can be decreased, and the increase in unnecessary power consumption and the increase in abrasion of the ignition plug 21 can be suppressed. On the contrary, it can be determined that as the peak value of the detection value of the primary voltage V1 becomes smaller, the magnitude of the breakdown voltage of the secondary voltage V2 is small, and ignitability is low. Accordingly, the threshold V1th can be increased, the energizing period of the sub primary coil 30 can be increased, and ignitability can be improved.

For example, when performing the low primary voltage on control, the sub coil control unit 6 sets a low threshold value V1th_L to the threshold value V1th, when the peak value of the detection value of the primary voltage V1 just after turning off the energization to the main primary coil 10 is larger than the peak determination value V1th_V2. The sub coil control unit 6 sets a high threshold value V1th_H, which is a larger value than the low threshold value V1th_L, to the threshold value V1th, when the peak value of the detection value of the primary voltage V1 is smaller than the peak determination value V1th_V2.

A control behavior will be explained using the time chart shown in FIG. 6 and FIG. 7. When performing the low primary voltage on control, FIG. 6 is the case where the peak value of the detection value of the primary voltage V1 is larger than the peak determination value V1th_V2, and FIG. 7 is the case where the peak value of the detection value of the primary voltage V1 is smaller than the peak determination value V1th_V2.

Figure 6:
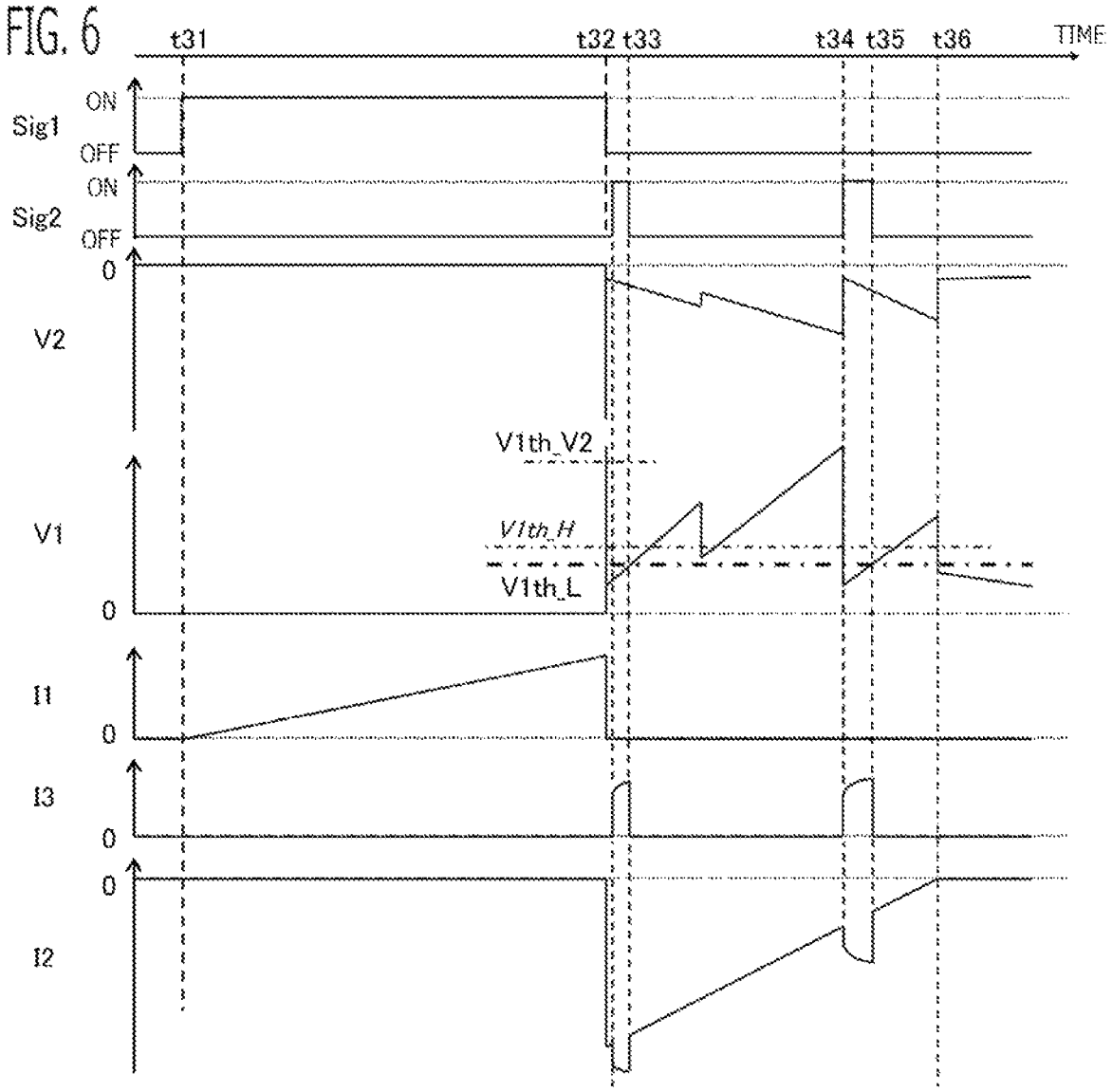
FIG. 6 is a time chart for explaining a control behavior when a peak value of the primary voltage is larger than a determination value according to Embodiment 2.

Since the time t31 to the time t32 of FIG. 6 is the same as the time t11 to the time t12 of FIG. 4, explanation is omitted. At the time t32, when the main coil control unit 5 switches the command signal Sig1 from ON to OFF and shuts down the energization of the main primary coil 10, the secondary voltage V2 drops to the breakdown voltage, and the spark discharge is generated by the dielectric breakdown. When the spark discharge starts, the secondary voltage V2 increases from the breakdown voltage, and becomes the discharge maintaining voltage. In the example of FIG. 6, since the charging efficiency is high and the pressure in cylinder is high, the magnitude of the breakdown voltage is large and the magnitude of the discharge maintaining voltage is large.

Accordingly, the peak value of the primary voltage V1 corresponding to the positive/negative reversing value of the breakdown voltage is larger than the peak determination value V1th_V2, and the low threshold value V1th_L smaller than the high threshold value V1th_H is set to the threshold value V1th. As a result, a period when the primary voltage V1 is less than the low threshold value V1th_L and the command signal Sig2 to the sub switch circuit 31 becomes ON decreases, and a period when the primary voltage V1 exceeds the low threshold value V1th_L and the command signal Sig2 to the sub switch circuit 31 becomes OFF increases. Therefore, when it can be determine that ignitability is high, the energizing period of the sub primary coil 30 can be decreased, and the increase in unnecessary power consumption and the increase in abrasion of the ignition plug 21 can be suppressed. The low primary voltage on control is performed in the spark discharge period from the time t32 to the time t36.

Figure 7:
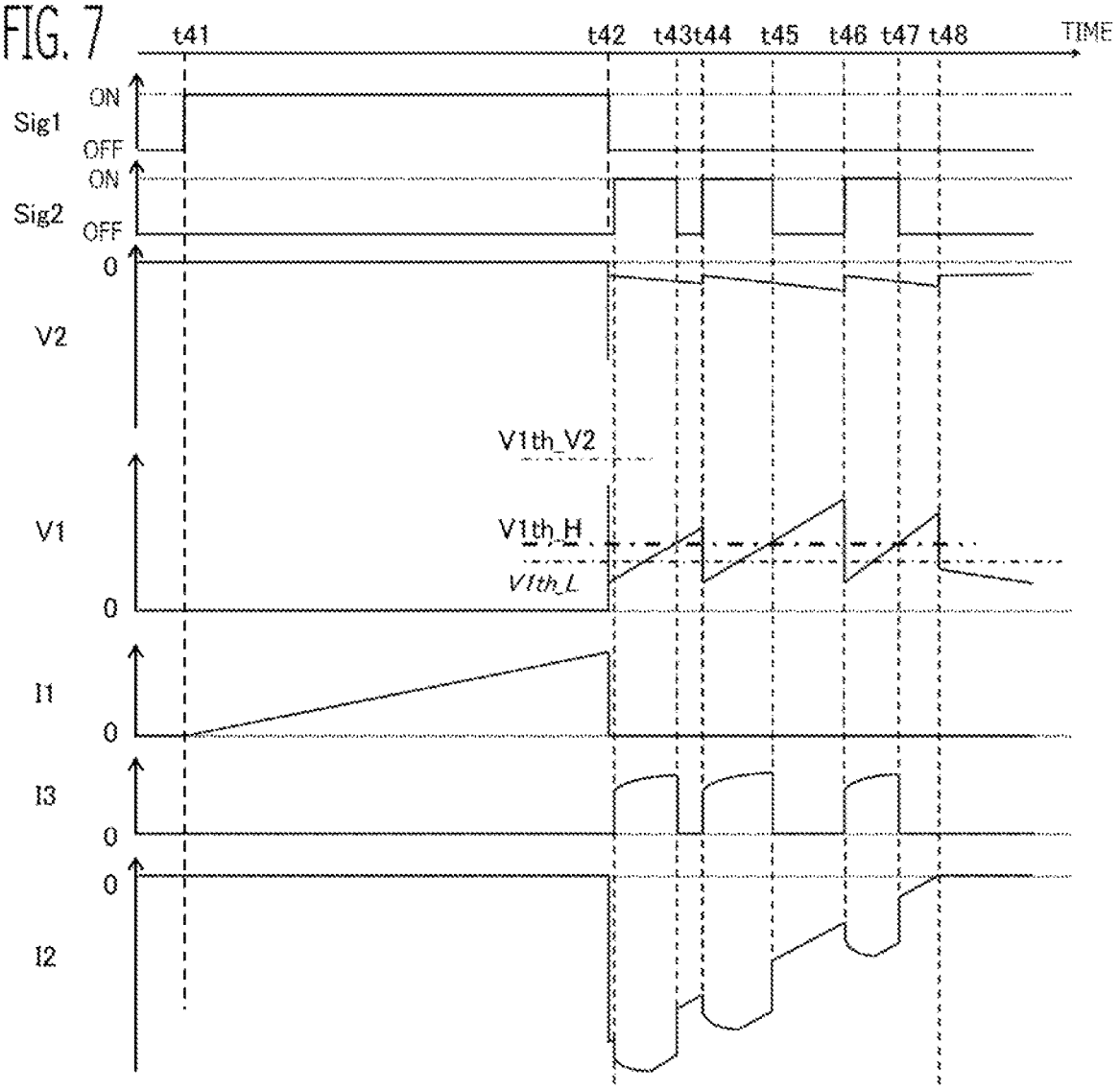
FIG. 7 is a time chart for explaining a control behavior when a peak value of the primary voltage is smaller than a determination value according to Embodiment 2.

At the time t42 of FIG. 7, when the main coil control unit 5 switches the command signal Sig1 from ON to OFF and shuts down the energization of the main primary coil 10, the secondary voltage V2 drops to the breakdown voltage, and the spark discharge is generated by the dielectric breakdown. When the spark discharge starts, the secondary voltage V2 increases from the breakdown voltage, and becomes the discharge maintaining voltage. In the example of FIG. 7, since the charging efficiency is low and the pressure in cylinder is low, the magnitude of the breakdown voltage is small and the magnitude of the discharge maintaining voltage is small.

Accordingly, the peak value of the primary voltage V1 corresponding to the positive/negative reversing value of the breakdown voltage is smaller than the peak determination value V1th_V2, and the high threshold value V1th_H larger than the low threshold value V1th_L is set to the threshold value V1th. As a result, a period when the primary voltage V1 is less than the high threshold value V1th_H and the command signal Sig2 to the sub switch circuit 31 becomes ON increases, and a period when the primary voltage V1 exceeds the high threshold value V1th_H and the command signal Sig2 to the sub switch circuit 31 becomes OFF decreases. Therefore, when it can be determined that ignitability is low, the energizing period of the sub primary coil 30 can be increased, and ignitability can be improved.

When performing the high primary voltage on control, the sub coil control unit 6 increases the threshold value V1th, as the peak value of the detection value of the primary voltage V1 just after turning off the energization to the main primary coil 10 is larger.

According to this configuration, it can be determined that as the peak value of the detection value of the primary voltage V1 becomes larger, the magnitude of the breakdown voltage of the secondary voltage V2 is large, and ignitability is high. Accordingly, the threshold value V1th can be increased, the energizing period of the sub primary coil 30 can be decreased, and the increase in unnecessary power consumption and the increase in abrasion of the ignition plug 21 can be suppressed. On the contrary, it can be determined that as the peak value of the detection value of the primary voltage V1 becomes smaller, the magnitude of the breakdown voltage of the secondary voltage V2 is small, and ignitability is low. Accordingly, the threshold V1th can be decreased, the energizing period of the sub primary coil 30 can be increased, and ignitability can be improved.

3. Embodiment 3

Next, the ignition apparatus 1 according to Embodiment 3 will be explained. The explanation for constituent parts the same as those in Embodiment 1 will be omitted. The basic configuration and processing of the ignition apparatus 1 according to the present embodiment are the same as those of Embodiment 1. However, in the present embodiment, the configuration of the sub coil control unit 6 is different from Embodiment 1.

In the present embodiment, the sub coil control unit 6 sets a setting value V1th_ON of the threshold value V1th used when determining whether or not the sub switch circuit 31 is turned on (hereinafter, referred to as an ON threshold value V1th_ON) and setting value V1th_OFF of the threshold value V1th used when determining whether or not the sub switch circuit 31 is turned off (hereinafter, referred to as an OFF threshold value V1th_OFF), to different values.

When performing the low primary voltage on control, the ON threshold value V1th_ON is set to a value smaller than the OFF threshold value V1th_OFF. On the other hand, when performing the high primary voltage on control, the ON threshold value V1th_ON is set to a larger value than the OFF threshold value V1th_OFF.

According to this configuration, by performing determination with hysteresis, the sub switch circuit 31 can be prevented from being turned on and off at high speed due to a minute change of the primary voltage V1, and turning on and off of the sub switch circuit 31 can be stabilized.

Figure 8:
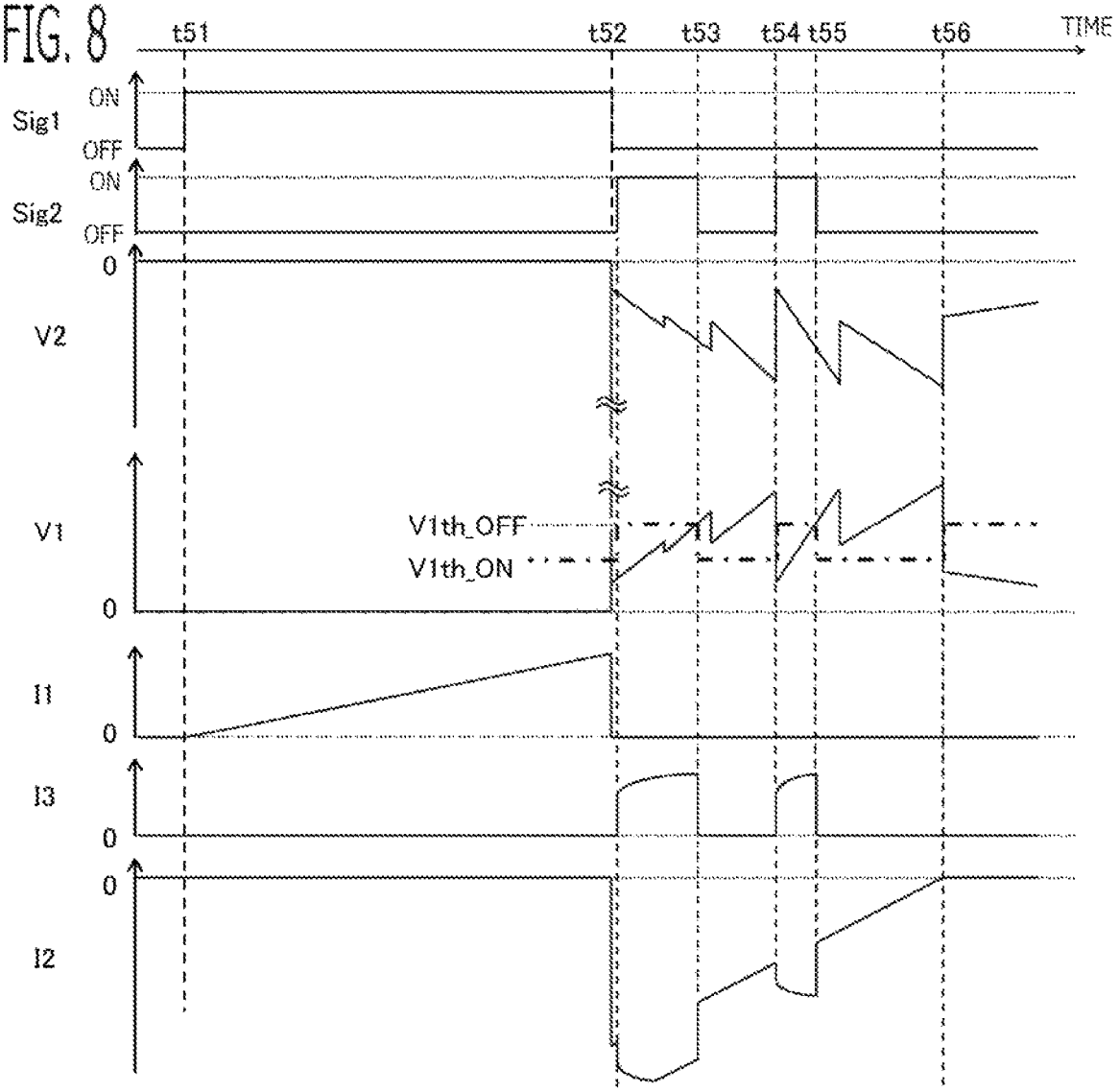
FIG. 8 is a time chart for explaining a control behavior according to Embodiment 3.

A control behavior when performing the low primary voltage on control will be explained using the time chart shown in FIG. 8. At the time t52, when the main coil control unit 5 switches the command signal Sig1 from ON to OFF and shuts down the energization of the main primary coil 10, the secondary voltage V2 drops to the breakdown voltage, and the spark discharge is generated by the dielectric breakdown. When the spark discharge starts, the secondary voltage V2 increase from the breakdown voltage, and becomes the discharge maintaining voltage.

At the start time point of the spark discharge of the time t52, since the sub primary coil 30 is OFF, and determination of whether to turn on the sub switch circuit 31 is performed, the threshold value V1th is set to the ON threshold value V1th_ON which set to a value smaller than the OFF threshold value V1th_OFF. Just after the time t52, since the primary voltage was less than the ON threshold value V1th_ON, the sub coil control unit 6 turns on the sub switch circuit 31.

Since determination of whether to turn off the sub switch circuit 31 is performed after turning on the sub switch circuit 31, the threshold value V1th is changed to the OFF threshold value V1th_OFF which is set to a larger value than the ON threshold value V1th_ON. At the time t53, since the primary voltage V1 exceeded the OFF threshold value V1th_OFF, the sub coil control unit 6 turns off the sub switch circuit 31.

Since determination of whether to turn on the sub switch circuit 31 is performed after turning off the sub switch circuit 31, the threshold value V1th is changed to the ON threshold value V1th_ON which is set to a value smaller than the OFF threshold value V1th_OFF. At the time t54, since the primary voltage V1 was less than the ON threshold value V1th_ON, the sub coil control unit 6 turns on the sub switch circuit 31.

After turning on the sub switch circuit 31, the threshold value V1th is changed to the OFF threshold value V1th_OFF. At the time t55, since the primary voltage V1 exceeded the OFF threshold value V1th_OFF, the sub coil control unit 6 turns off the sub switch circuit 31. After that, at the time t56, the magnetic energy accumulated in the iron core is lost, and the spark discharge is finished. The low primary voltage on control is performed in the spark discharge period from the time t52 to the time t56.

During the spark discharge from the time t52 to the time t56, the primary voltage V1 minutely changes due to shortening of the discharge path and the like. However, by performing determination with hysteresis, the sub switch circuit 31 can be prevented from being turned on and off at high speed, and turning on and off of the sub switch circuit 31 can be stabilized.

4. Embodiment 4

Figure 9:
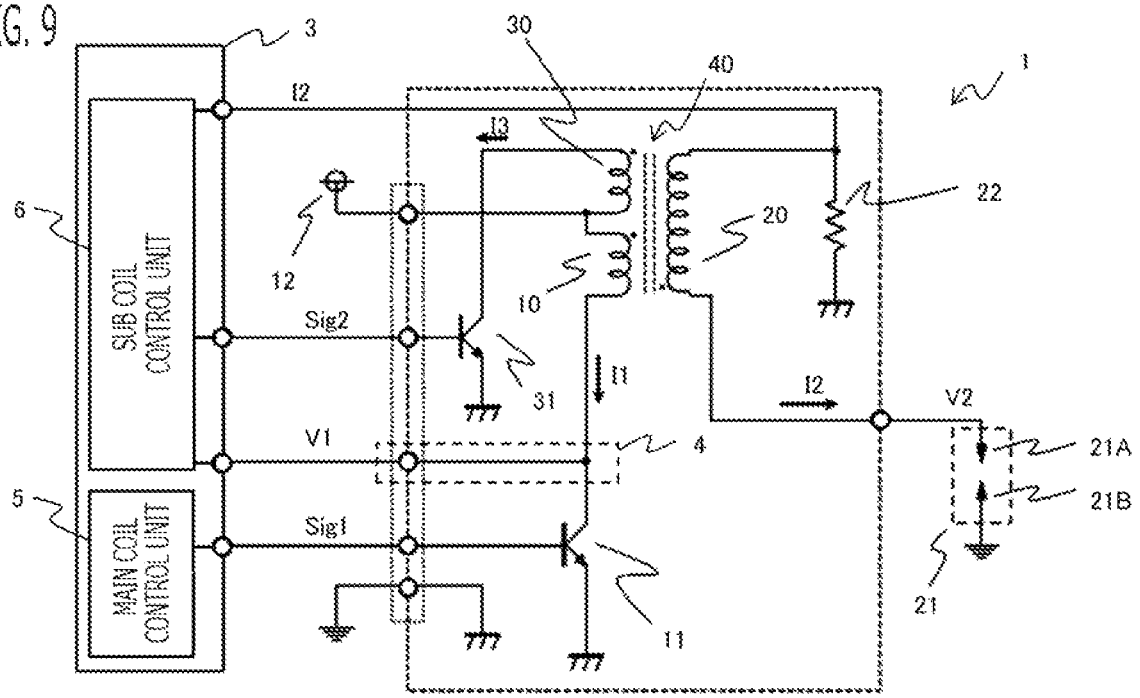
FIG. 9 is a schematic circuit diagram of the ignition apparatus according to Embodiment 4.

Next, the ignition apparatus 1 according to Embodiment 4 will be explained. The explanation for constituent parts the same as those in Embodiment 1 will be omitted. The basic configuration and processing of the ignition apparatus 1 according to the present embodiment are the same as those of Embodiment 1. However, in the present embodiment, the ignition apparatus 1 is provided with a secondary current detection circuit 22, and the configuration of the sub coil control unit 6 is different from Embodiment 1. FIG. 9 shows a circuit configuration of the ignition apparatus 1 according to the present embodiment 4.

The secondary current detection circuit 22 is a circuit for detecting the secondary current I2 which flows into the secondary coil 20. In the present embodiment, the secondary current detection circuit 22 is a resistance (hereinafter, referred to as a secondary current detection resistance 22) which is connected in series on the discharge path of the secondary current I2. A low voltage side terminal of the secondary current detection resistance 22 is connected to the ground, and a high voltage side terminal of the secondary current detection resistance 22 is connected to the other end of the secondary coil 20. A voltage of the high voltage side terminal of the secondary current detection resistance 22 is inputted into the controller 3. The secondary current detection circuit 22 may be a current transformer or a Hall sensor arranged on the discharge path of the secondary current I2.

When the magnitude (absolute value) of the detection value of the secondary current I2 is less than a current threshold I2th, the sub coil control unit 6 turns on the sub switch circuit 31, and turns on the energization to the sub primary coil 30.

According to this configuration, in a latter half of the discharge period when the magnitude of the secondary current I2 drops and the output energy of the ignition coil 40 drops, by energizing the sub primary coil 30, increasing the magnitude of the secondary current I2, and strengthening the spark discharge, ignitability can be improved. Even when consumption of the magnetic energy accumulated in the iron core increases by extension of the discharge path and the discharge period becomes short, energy supply required for ignition can be maintained in the latter half of the discharge period. In the first half of the discharge period, by turning on and off energization of the sub primary coil 30 based on the detection value V1 of the terminal voltage of the main primary coil, electrode consumption can be suppressed.

Figure 10:
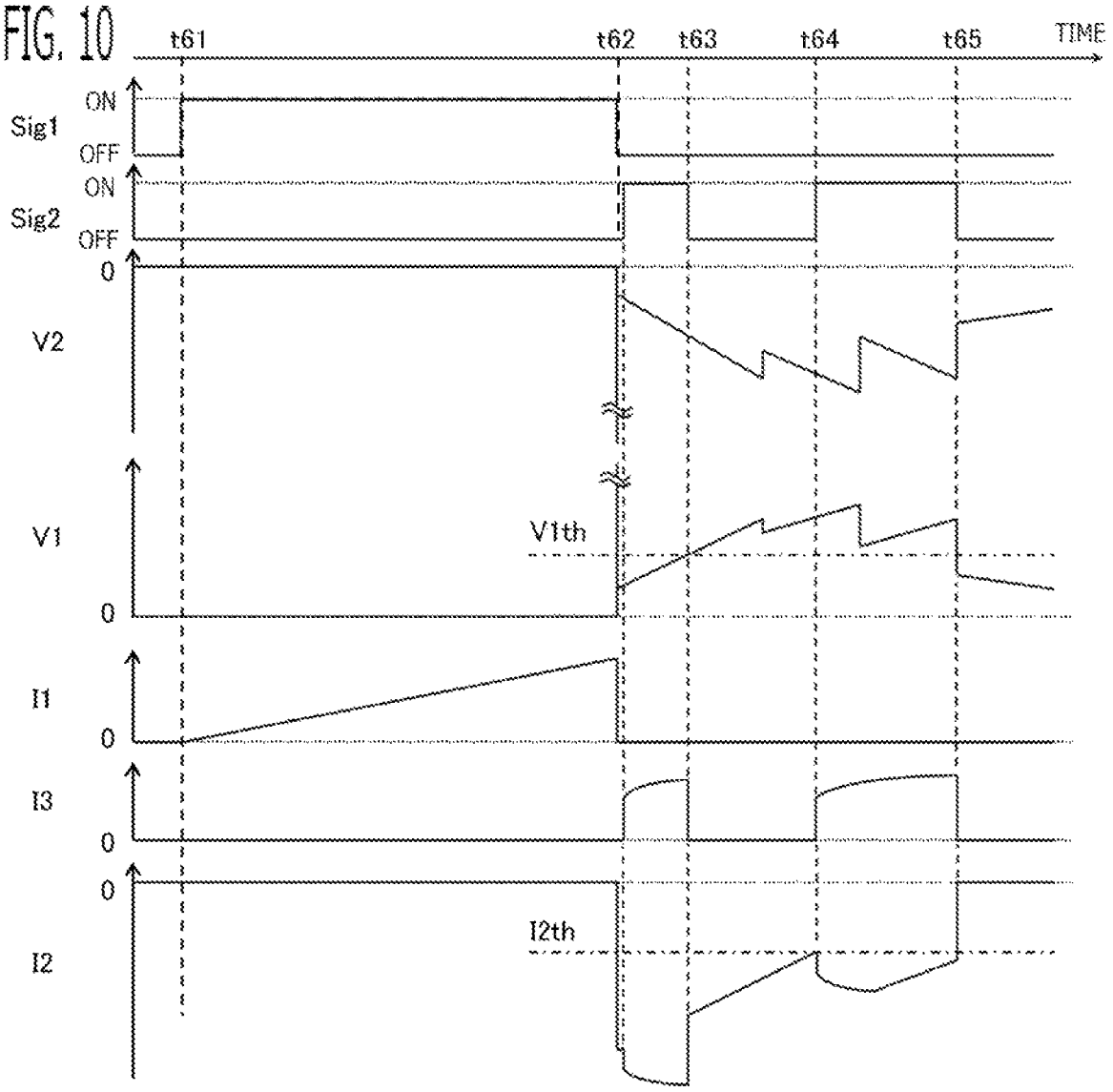
FIG. 10 is a time chart for explaining a control behavior according to Embodiment 4.

A control behavior will be explained using the time chart shown in FIG. 10. Since the time t61 to the time t62 of FIG. 10 is the same as the time t11 to the time t12 of FIG. 4, explanation is omitted. At the time t62, when the main coil control unit 5 switches the command signal Sig1 from ON to OFF and shuts down the energization of the main primary coil 10, the secondary voltage V2 drops to the breakdown voltage, and the spark discharge is generated by the dielectric breakdown.

In the present embodiment, the low primary voltage on control is performed. Just after the time t62, since the primary voltage V1 was less than the threshold value V1th, the sub coil control unit 6 turns on the sub switch circuit 31. At the time t63, since the primary voltage V1 exceeded the threshold value V1th, the sub coil control unit 6 turns off the sub switch circuit 31.

After that, the secondary current I2 decreases gradually as the magnetic energy accumulated in the iron core decreases. At the time t64, since the magnitude (absolute value) of the detection value of the secondary current I2 was less than the current threshold I2th, the sub coil control unit 6 turns on the sub switch circuit 31, and turns on the energization to the sub primary coil 30. After that, at the time t65, discharge is finished by decrease of the magnetic energy accumulated in the iron core, and the sub coil control unit 6 turns off the sub switch circuit 31, and turns off the energization to the sub primary coil 30. In this way, in the latter half of the discharge period, the sub primary coil 30 is energized, the magnitude of the secondary current I2 is increased, and the spark discharge can be strengthened.

Although the present disclosure is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations to one or more of the embodiments. It is therefore understood that numerous modifications which have not been exemplified can be devised without departing from the scope of the present disclosure. For example, at least one of the constituent components may be modified, added, or eliminated. At least one of the constituent components mentioned in at least one of the preferred embodiments may be selected and combined with the constituent components mentioned in another preferred embodiment.

What is claimed is:

1. An ignition apparatus comprising:

an ignition coil that is provided with a main primary coil which generates energization magnetic flux by energization, a sub primary coil which generates energization magnetic flux of a direction opposite to the energization magnetic flux of the main primary coil by energization, and a secondary coil which is magnetically coupled with the main primary coil and the sub primary coil and supplies spark discharge energy to a spark plug;

a main switch circuit that turns on and off energization to the main primary coil from a DC power source;

a sub switch circuit that turns on and off energization to the sub primary coil from the DC power source;

a main voltage detection circuit that detects a terminal voltage of the main primary coil;

a main coil controller that turns on the main switch circuit to turn on energization to the main primary coil, and then turns off the main switch circuit to turn off energization to the main primary coil and makes the ignition plug generate spark discharge; and a sub coil controller that, after turning off energization to the main primary coil, based on a detection value of the terminal voltage of the main primary coil, turns on and off the sub switch circuit to turn on and off energization to the sub primary coil and additionally supply spark discharge energy to the secondary coil.

2. The ignition apparatus according to claim 1, wherein the sub coil controller performs a low primary voltage on control that turns on the sub switch circuit to turn on energization to the sub primary coil when the detection value of the terminal voltage of the main primary coil is less than a threshold value, and turns off the sub switch circuit to turn off energization to the sub primary coil when the detection value of the terminal voltage of the main primary coil exceeds the threshold value.

3. The ignition apparatus according to claim 1, wherein the sub coil controller performs a high primary voltage on control that turns on the sub switch circuit to turn on energization to the sub primary coil when the detection value of the terminal voltage of the main primary coil exceeds a threshold value, and turns off the sub switch circuit to turn off energization to the sub primary coil when the detection value of the terminal voltage of the main primary coil is less than the threshold value.

4. The ignition apparatus according to claim 1, wherein the sub coil controller switches and performs a low primary voltage on control and a high primary voltage on control according to operating condition of an internal combustion engine, wherein in the low primary voltage on control, the sub coil controller turns on the sub switch circuit to turn on energization to the sub primary coil when the detection value of the terminal voltage of the main primary coil is less than a threshold value, and turns off the sub switch circuit to turn off energization to the sub primary coil when the detection value of the terminal voltage of the main primary coil exceeds the threshold value, and wherein in the high primary voltage on control, the sub coil controller turns on the sub switch circuit to turn on energization to the sub primary coil when the detection value of the terminal voltage of the main primary coil exceeds a threshold value, and turns off the sub switch circuit to turn off energization to the sub primary coil when the detection value of the terminal voltage of the main primary coil is less than the threshold value.

5. The ignition apparatus according to claim 2, wherein the sub coil controller changes the threshold value according to a peak value of the detection value of the terminal voltage of the main primary coil just after turning off the energization to the main primary coil.

6. The ignition apparatus according to claim 2, wherein when performing the low primary voltage on control, the sub coil controller decreases the threshold value, as the peak value of the detection value of the terminal voltage of the main primary coil just after turning off the energization to the main primary coil is larger.

7. The ignition apparatus according to claim 3, wherein when performing the high primary voltage on control, the sub coil controller increases the threshold value, as the peak value of the detection value of the terminal voltage of the main primary coil just after turning off the energization to the main primary coil is larger.

8. The ignition apparatus according to claim 2, wherein the sub coil controller sets a setting value of the threshold value used when determining whether or not the sub switch circuit is turned on and a setting value of the threshold value used when determining whether or not the sub switch circuit is turned off, to different values.

9. The ignition apparatus according to claim 1, further comprising a secondary current detection circuit that detects a secondary current which flows into the secondary coil, wherein when a magnitude of a detection value of the secondary current is less than a current threshold, the sub coil controller turns on the sub switch circuit to turn on energization to the sub primary coil.

* * * * *